United States Patent [19]

Kreuter

[11] Patent Number: 4,719,882

[45] Date of Patent: Jan. 19, 1988

[54] ELECTROMAGNETIC-POSITIONING SYSTEM FOR GAS EXCHANGE VALVES

[76] Inventor: Peter Kreuter, Josef-Ponten Str. 38, Aachen 5100, Fed. Rep. of Germany

[21] Appl. No.: 850,938

[22] Filed: Apr. 11, 1986

[30] Foreign Application Priority Data

Apr. 12, 1985 [DE] Fed. Rep. of Germany ..... 3513105

[51] Int. Cl.[4] ..... F01L 9/04; H01F 7/16

[52] U.S. Cl. ..... 123/90.11; 251/129.1; 251/129.16; 251/129.18; 335/266

[58] Field of Search ..... 123/90, 11; 251/129.09, 251/129.1, 129.16, 129.18; 335/256, 258, 262, 266, 268

[56] References Cited

U.S. PATENT DOCUMENTS

| | | | |
|---|---|---|---|
| 3,412,971 | 11/1968 | McDivitt | 251/129.1 |
| 3,882,833 | 5/1975 | Longstaff et al. | 123/90.11 |
| 4,455,543 | 6/1984 | Pischinger et al. | 335/266 |

*Primary Examiner*—Tony M. Argenbright
*Attorney, Agent, or Firm*—Jacques M. Dulin

[57] ABSTRACT

An improved actuator assembly for an electromagnetically-actuated spring-loaded positioning system in displacement machines, such as for lifting valves in internal combustion engines. The positioning mechanism has a spring system and two electrically-operated, opposed actuating solenoids, by means of which the actuator may be moved between, and held at, two discrete, mutually-opposite operating positions. The improved actuator assembly of the invention comprises an actuator anchor plate secured to a guide rod which reciprocatingly engages a guide sleeve. The guide rod is moved back and forth by solenoids acting on the anchor plate, and comes into contact with a separate valve stem, by means of which the valve is opened and closed. The required tolerances for (a) the guideway for the valve stem, and (b) the guideway for the guide rod operating inside the electromagnetic unit, may thus be separately evaluated and selected. The separate guide rod and valve stem arrangement permits precise adjustment of valve travel. The entire positioning system is constructed as an easily replaceable module in its own housing unit.

20 Claims, 3 Drawing Figures

ELECTROMAGNETIC-POSITIONING SYSTEM FOR GAS EXCHANGE VALVES

FIELD

The invention concerns an improved actuator assembly for electromagnetically-actuated positioning systems for spring-loaded reciprocating actuators in displacement machines, such as for lifting valves of internal combustion engines. The positioning mechanism has a spring system and two electrically-operated, opposed actuating solenoids, by means of which the actuator may be moved between, and held at, two discrete, mutually-opposite operating positions, valve open and valve closed. The improved actuator assembly of the invention comprises an actuator anchor plate secured to a guide rod which reciprocatingly engages a guide sleeve. The guide rod carries a tappet member that contacts the end of the valve stem rod. The valve stem end is spaced apart from the guide rod in the valve closed position. The guide rod is axially adjustable, thereby permitting precise control of valve travel.

BACKGROUND

A similar system is known from DE-OS No. 30 24 109.

This known device shows a gas exchange valve for an internal combustion engine, the stem of which is joined to the valve disk and has an anchor plate which is alternatingly attracted to two actuating solenoids, causing the valve to open or close. This anchor plate is directly attached to the valve stem.

As the accuracy of anchor plate guidance between the solenoids must be relatively high, precise guidance of the valve stem is necessary. Problems may be encountered in this regard, particularly with the exhaust valves of internal combustion engines, as said exhaust valves are simultaneously subject to severe thermal stress.

Furthermore, assembly of this known device is relatively problematic.

In the normal operating RPM range of modern engines, the valve actuators must change positions frequently, at precise intervals, and their stroke must be the full length of intended travel. At the high temperatures and frequency of movement, friction due to even slight misalignment or thermal expansion of the parts can delay properly timed valve opening and closing, increase or reduce valve opening, or hinder complete closing, thereby causing reduced engine performance. There is thus a significant need for improved valve actuator assembly systems which permit precise valve travel adjustment.

THE INVENTION

Objects

It is among the objects of the invention to provide a type-conformable device offering relative ease of assembly.

It is another object of this invention to provide an improved valve actuator assembly which is separate from the valve disc and valve stem assembly.

It is another object of the invention to provide an improved system for accurately guiding actuator rods of spring-loaded reciprocating actuator assemblies in displacement machines, such as are used in conjunction with lifting valves of internal combustion engines.

It is another object of the invention to provide an improved valve actuator assembly in which the valve actuator does not come into contact with the valve stem in the valve "closed" position.

It is another object of this invention to provide an improved valve actuator assembly which includes actuating and adjusting assemblies in a separate housing which is preassembled for ease of mounting over the valve stem, and which permits precise and simple adjustment of the valve stroke.

Still other objects will be evident from the following specification, drawing and claims.

The Drawings

Summary

Figure 1:
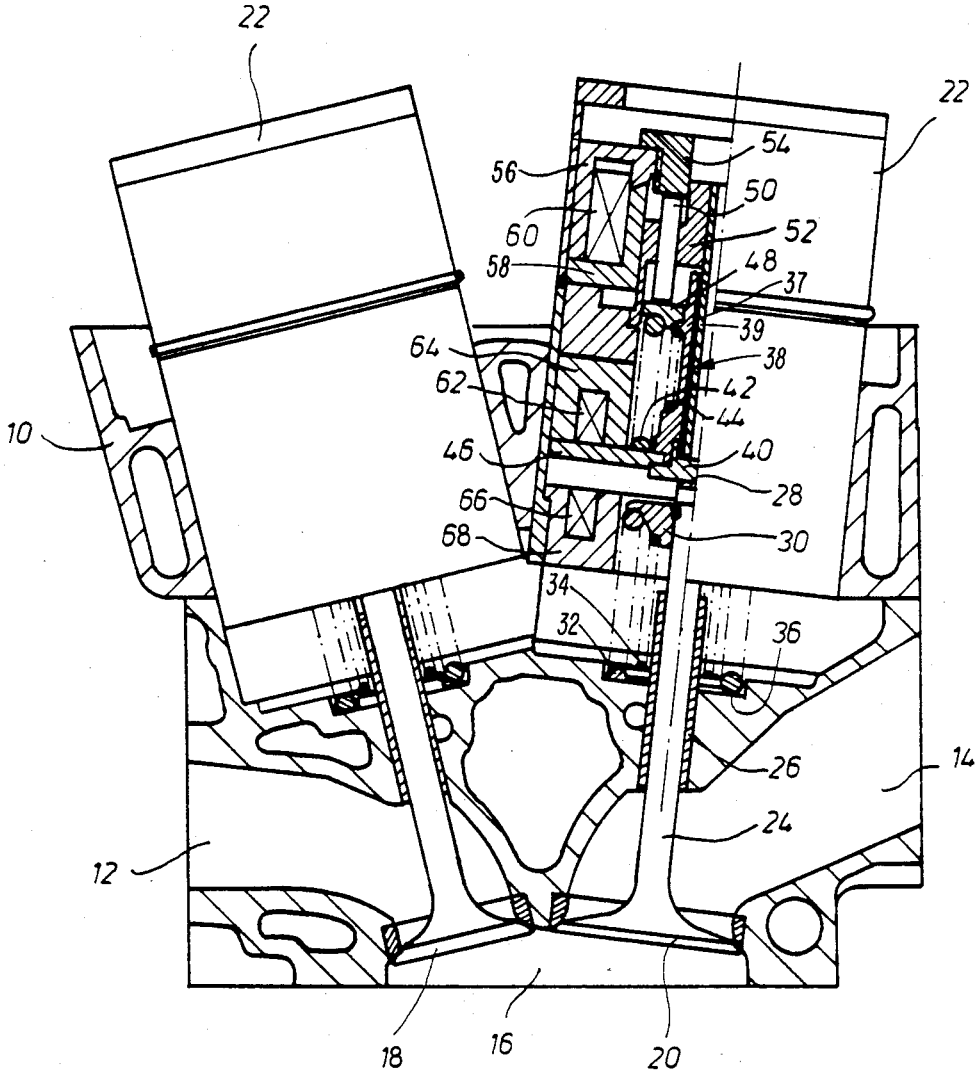
FIG. 1 shows a side elevation, partly in section, of the improved actuator assembly of this invention in which the guide assembly and anchor plate are separate from the valve stem.

The objects of the invention are achieved by providing an actuator assembly comprising a guide assembly having a guide rod carrying an anchor plate, which actuator assembly is not integrally joined to the gas exchange valve. Rather, one end of the actuator assembly guide rod acts upon the valve stem, from which it is separate, and causes the valve disk to lift due to pressure on the valve stem Preferred embodiments include: the actuator assembly intermittently moving out of contact with the valve stem, particularly when the valve is in the closed position; the guide rod being guided with greater accuracy than the valve stem; the valve stem being lubricated while the guide rod slides in a dry bearing; the entire assembly of actuating and adjusting solenoids, spring system and actuator assembly are contained in a preassembled unit which slips over the valve stem and is so mounted (by shims or rings around bolts) to permit simple adjustment thereof for precise adjustment of valve travel; employment of rotatable shim stacks to adjust the valve travel; and providing a larger bore for the spring system than for the guide sleeve. To permit operation with the lowest possible power consumption, the two rods (i.e., guide rod and valve stem) should be coaxially mounted.

The actuator assembly of the invention is particularly suited for electromagnetically-actuated positioning mechanisms for spring-loaded valve actuator assemblies in displacement machines, such as are used with lifting valves of internal combustion engines. The overall positioning mechanism has a spring system and two electrically-operated, opposed actuating solenoids. By alternately energizing the solenoids, the actuator assembly may be moved between, and held (for a predetermined desired length of time) at two discrete, mutually-opposite operating positions, e.g., valve open and valve closed positions. The positioning mechanism also includes an adjusting solenoid which serves to shift the locus of the spring system equilibrium from a point centered between operating positions to a non-central point. This is accomplished by the adjusting solenoid shifting a support which acts as one seat of the spring system. The spring support is preferably secured to the guide assembly, either guide rod or sleeve.

The actuator assembly comprises a guide rod and a ferromagnetic anchor plate which is positioned between the core faces of the two actuating solenoids. One end of the guide rod may be adapted with a tappet member which may include a slightly pointed face to contact the valve stem end. The other end may be secured to the ferromagnetic anchor plate of the adjusting solenoid assembly. For further details of the overall actuator system see my copending applications Nos. 532.4004, 532.0006, and 532.0007, and that of Josef Buchl No. 532.0008, all filed of even date hereof, the disclosures of which are incorporated by reference herein.

In one operating position, the gas exchange valve is preferably fully opened by pressure on the valve stem by the actuator assembly guide rod, whereas in the other operating position, corresponding to the "closed" position of the gas exchange valve, the guide rod is slightly raised away from the valve stem, so that the mechanism operates with a slight clearance. This ensures a reliably positive closure of the gas exchange valve under all conditions of tolerance, including a given amount of valve-disk or valve-seat pitting or wear, and lengthening of the valve stem by expansion from engine operation heat.

The system pursuant to the invention also shows particular advantages inasmuch as the guideway for the guide rod is separate from the guideway for the valve shaft. Allowance is thus provided for the fact that the guide sleeve requires extremely accurate guidance, whereas the valve stem may be guided with a lower degree of precision and under broader tolerances. Deliberately providing overly large tolerances for the valve-stem guideway is helpful in engine design precisely due to the fact that valves in internal-combustion engines—and particularly exhaust valves—are subject to extreme temperature variations. Thus cold play is needed to compensate for heat expansion, but this adversely affects precise valve adjustment. Pursuant to the invention, the necessarily-accurate guide-rod guidance can be ensured independently of the valve-stem loose tolerance requirements.

It is thereby possible to provide oil lubrication for the valve stem, while the guide rod travels in a dry bearing.

A valve actuator assembly unit (composed of a portion of the spring system, actuating solenoids, guide rod and guide sleeve) is particularly easy to assemble. This system may be installed in a housing forming the actuator unit module, and, as required, repair is accomplished by module replacement. For assembly, the gas exchange valves and the valve portion of the spring system are installed in the cylinder head, uponn which the preassembled, complete housing, containing the required components, may be directly mounted and bolt-fastened. The complicated assembly of the valve-actuating mechanism directly on the engine may thus be eliminated.

In a preferred embodiment, the annular actuating solenoids form a cylindrical cavity or bore housing the spring system. The guide rod follows an axial path in the direction opposite the valve disk. The upper end of the guide rod fits into a guide sleeve housed in a bore surrounded by an adjusting solenoid. The adjusting solenoid acts to shift the position of equilibrium of the spring system, which may be as described in DE-OS No. 30 24 109. As the bore diameter is smaller in the region of the adjusting solenoid than in the region of the actuating solenoid, adjusting-solenoid construction may be wider in diameter, thereby reducing the height of the overall unit.

Valve travel is adjustable in a simple manner by displacing the height of the module housing (containing the adjusting solenoid, one actuating solenoid, guide rod and guide sleeve) relative to the cylinder head. To this end, appropriate shims may be inserted under the bolts at those points where the positioning system module is bolted to the cylinder head. In some cases this creates a hazard of tilting the positioning system, so that the valve stem and the guide rod-anchor plate assembly are no longer coaxial. To prevent this tilting, it is preferred to provide an axially adjustable ring assembly circumferentially surrounding the entire housing, whereby tilt-free mounting of the unit is ensured.

Instead of a single ring, the adjusting system may comprise one or more rings whereby at least two rings present oblique mating surfaces such that, when rotated relative to one another, their overall height increases or decreases. Valve travel can thus be easily and continuously adjustable merely by rotating the rings relative to one another. One example is matingly engaging threaded cylinders or rings.

Detailed Description of the Best Mode of the Invention

The following detailed description of the best mode of carrying out the invention makes reference to the figures, and is by way of example and not by way of limitation of the principles of the invention.

FIG. 1 illustrates a cross-section from the engine block of an internal combustion engine. Item 10 indicates the cylinder head. An intake port 12, which may be selectively closed with an intake valve 18, leads into cylinder bore 16. An exhaust port 14, which may be selectively closed with an exhaust valve 20, leads out of cylinder bore 16. Valves 18 and 20 are actuated by an electromagnetic positioning system situated in housing 22. The unit situated in housing 22 is preferably identical for both intake and exhaust valves, in order to reduce the range of parts required. Nonetheless, it is possible to match intake and exhaust valve characteristics to specific design requirements. It may thus be observed in FIG. 1 that the disk of exhaust valve 20 is larger than the disk of intake valve 18.

As there is no theoretical difference between intake and exhaust valve construction, the following discussion will refer to the exhaust valve only.

Valve disk 20 is integral with valve stem 24 which slides in valve guide 26, inserted in cylinder head 10. The end of valve stem 24, indicated as Item 28, has a bearing surface which contacts a tappet 40, to be described below.

A flange 30 is circumferentially mounted on the end of valve stem 24 opposite valve disk 20. Flange 30 acts as a seat for a spring system consisting of a large spiral spring 32 and a small spiral spring 34. Both spiral springs 32 and 34 are coaxially installed. The opposite spring seat 36 is formed by a bearing surface in the cylinder head. Valve stem 24 may be actuated in valve guide 26 against the loading of springs 32 and 34, causing valve disk 20 to rise off its seat and open exhaust port 14.

Figure 2:
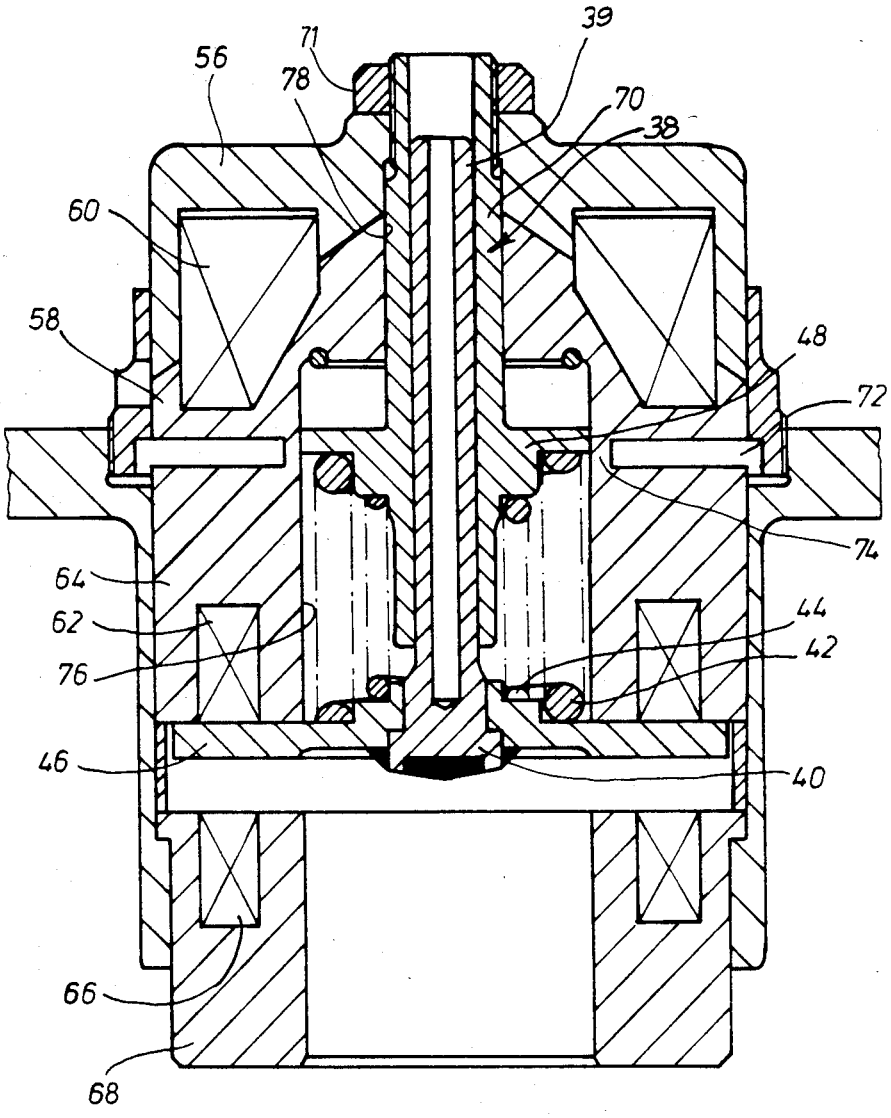
FIG. 2 shows in enlarged section view another embodiment of the invention in which the guide sleeve for the actuator rod is secured at its upper end to the anchor plate assembly of an adjusting solenoid.

An unconnected axial extension to valve stem 24 is formed by actuator rod 38, the lower end of which is fitted with tappet 40, which makes contact with valve stem 26. To open valve 20, tappet 40 contacts end 28 of valve stem 26, pushing valve stem 26 to the "open" position of valve disk 20. Rod 38 may be in the form of a tubular sleeve 37, which is guided by a shaft or tube 39 situated (disposed) in this sleeve. This embodiment is illustrated in FIG. 1. Alternatively, as shown in FIG. 2, rod 39 may be a shaft or tube guided in a sleeve 70. An annular anchor plate 46, made of ferromagnetic material, is joined to actuator rod 38 in the region of tappet 40. This anchor plate also supports a spring system consisting of a large sprial spring 42 and small spiral spring 44, which are also coaxial to one another and to rod 38.

The seat for this spring system 42 and 44 is formed by a support 48, to be described in greater detail below.

A magnet core 68 having a U-shaped cross-section to form a cup magnet, is annularly installed with the axis of the annulus coinciding with the axis of valve stem 24. A coil 66 is situated inside magnet core 68. The open side (face) of U-sectioned magnet core 68 faces in the direction of anchor plate 46.

Actuator rod 38 is likewise surrounded by a similarly shaped magnet core 64, inside of which is a coil 62. Depending on energizing solenoids 62 and 66, anchor plate 46 moves from a contact face on magnet core 64 to a contact face on magnet core 68, and back again.

Also provided is an adjusting solenoid consisting of a magnet core 58 and a coil 60. Energizing coil 60 attracts ferromagnetic component 56, which is joined to part 54. This movement, caused by energizing adjusting solenoid coil 60 and acting on part 54, is transmitted by means of pin 50, placed in a cover plate 52, to the spring-system seat formed by support 48, whereby energizing adjusting solenoid coil 60 shifts the seat of springs 42 and 44.

Pursuant to the invention, a separation is provided between guide rod assembly 38, the rod (or tube) 39 of which can slide in a central bore in cover plate 52 (FIG. 1), or rod 38 itself slides in sleeve 70 (FIG. 2), and valve stem 24, which slides in valve guide 26. As exhaust valve 20 is relatively highly heated by escaping, burnt exhaust gases, high demands will be placed on the heat resistance of valve guide 26; oil lubrication may be provided for the valve guide as needed.

The demands on the guide sleeve for guide rod 38 are of a different nature. Particular attention must be paid to the fact that anchor plate 46 must be very accurately guided, as only slight tilting caused by inaccurate guidance would impede sliding travel, leading to time lags. At high engine speeds, however, the actuating events caused by action of solenoids 62 and 66 on anchor plate 46 must take place very rapidly, so that the guidance for anchor plate 46, determined by guide rod 38 and guide sleeve 52, is absolutely critical.

Pursuant to the invention, both demands may be reconciled by a separation of guide rod and valve stem.

FIG. 2 shows a variant form for guide rod 38, sliding in guide sleeve 70.

The index numbers refer to the same items as in FIG. 1, but FIG. 2 differs in that core 64 of actuating solenoid 62 is separated from core 58 of adjusting solenoid 60 by a magnetic gap 72. The term "magnetic gap" signifies that said gap 72 presents a magnetic field with the same properties as an air gap, and this shows no ferromagnetic properties. The gap also presents a resistance to eddy currents. It is therefore not necessary for gap 72 to be air-filled, and it may be composed of other materials, such as paramagnetic or diamagnetic materials. In order to preserve single-piece construction for adjusting-solenoid core 58 and actuating solenoid core 64, however, both of these cores may be joined at point 74, e.g., by electron beam welding. By comparison, a large-area joint without magnetic gap would result in undesired field effects of solenoid 60 on core 64 and solenoid 62 on core 58. For more details of this construction see my copending application Ser. No. 850,939, not assigned.

Upon application of current to core 58, adjusting solenoid 60 attracts ferromagnetic component 56, which is joined to guide sleeve 70, causing guide sleeve 70 to move downward. Guide sleeve 70 has a circumferential flange 48 which acts as a seat for the spring system consisting of springs 42 and 44. The movement of guide sleeve 70 to its operating position upon energizing solenoid 60 establishes the locus of equilibrium of the spring system midway between actuating solenoids 62 and 66.

Bore 76, a cylindrical cavity completely surrounded by magnet core 64 and/or 58, is provided to house the spring systems, guide sleeve 70 and guide rod 38. The diameter of bore 76 is adjusted to match the space requirements of spring system 42 and 44 and support 48.

It is to be noted that the diameter of the extension of the guide rod running from the anchor plate into guide sleeve 70 is smaller than that of bore 76, such that cylindrical space 78, which is bounded by solenoids, has a smaller internal diamter than bore 76 in this region. The additional space thus gained for adjusting solenoid 60, filled by core 58, makes it possible to reduce the physical height of adjusting solenoid 60.

The entire unit shown in FIG. 2 may be preassembled into assembly/replacement modules as follows. Assembly is essentially performed such that guide sleeve 70 is inserted from underneath into the cuplike assembly of core 64 and core 58. Ferromagnetic anchor plate component 56 is slipped over the upper end of sleeve 70, which is then joined with said ferromagnetic component 56, e.g., by nut 71. Springs 44 and 42, followed by guide rod 38 which is joined to anchor plate 46, may then be installed. A self-contained unit is formed with subsequent attachment of core 68.

During engine assembly, valve 20 is installed in the customary manner. Springs 32 and 34 are threaded on valve stem 24, after which support 30 for springs 32 and 34 is attached. All that remains is for the complete unit described above to be mounted over the stem of the installed valve, and housing 22 bolted to cylinder head 10 (See FIG. 3).

Figure 3:
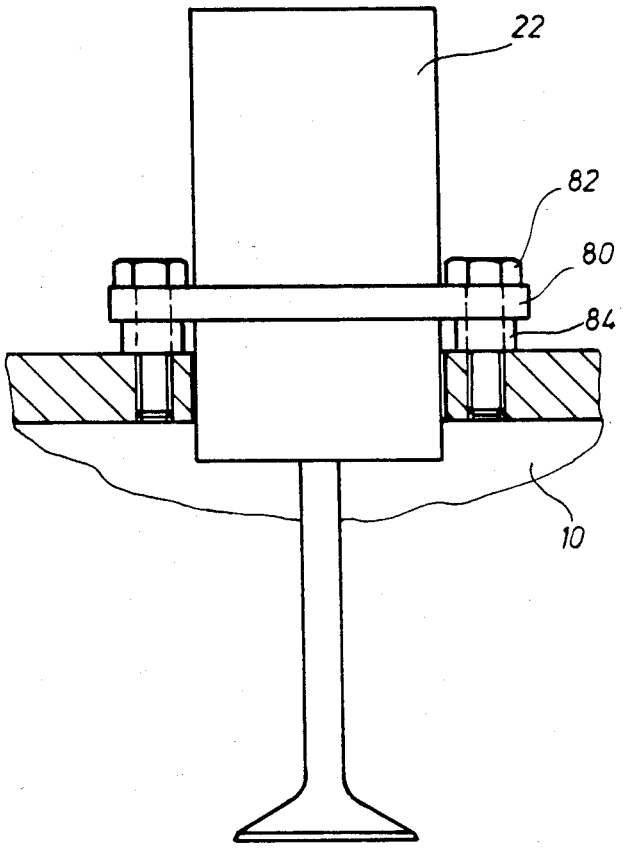
FIG. 3 shows a side elevation view, partly in section, of the preassembled actuator unit of the invention having means for simple adjustability of the actuator anchor plate with respect to the valve stem permitting precise control of valve travel.

FIG. 3 indicates that housing 22 is provided with a circumferential flange 80, containing boreholes for passage of bolts 82, which engage cylinder head 10. Item number 84 refers to shims for adjustment of the height of housing 22 relative to cylinder head 10, and thus relative to the valve seat, whereby valve travel is also adjustable.

Shims 84 may be replaced by a ring, circumferentially surrounding housing 22 and positioned between flange 80 and cylinder head 10. This arrangement guarantees the accurate alignment of the positioning mechanism relative to the cylinder head and the valve stem.

An appropriately threaded shim or ring construction, or oblique (tapered) frontal surfaces upon which the shims bear against one another, provide a simple valve adjustment mechanism, as the clearance between flange 80 and cylinder head 10 can be adjusted by simple rotation of the shims or ring system.

It should be understood that various modifications within the scope of this invention can be made by one of ordinary skill in the art without departing from the spirit thereof. I therefore wish my invention to be defined by the scope of the appended claims as broadly as the prior art will permit, and in view of this apecification if need by.

I claim:

1. An improved actuator assembly for an electromagnetically-actuated positioning mechanism of spring-loaded valve-type reciprocating actuators in displacement machines, comprising in operative combination:

(a) means comprising an assembly for reciprocatingly actuating a valve member, said valve member being movable between a first, closed operating position to a second, open operating position;

(b) said reciprocating actuator assembly including a guide assembly comprising an anchor guide member and a single electromagnetically attractable anchor plate member secured adjacent one end thereof, said actuator assembly being disposed to permit said valve member movement;

(c) at least one actuating solenoid disposed to selectively attract said actuator anchor plate into a position permitting said valve to move to said closed operating position;

(d) means for guiding said anchor guide member in reciprocating association therewith, said anchor guide member guiding the travel of said anchor plate into said position permitting said valve member operating position movement, and said guide means being reciprocable relative to said actuating solenoid;

(e) said guide assembly being separate from said valve member;

(f) said valve member comprising a valve stem free of an anchor plate; and said anchor guide member and said valve stem are disposed mutually coaxial;

(g) means for contacting one end of said valve stem disposed adjacent an end of said anchor guide member;

(h) said anchor guide member contact means is disposed spaced apart from said end of said valve stem when said valve is in said first, closed position;

(i) said anchor guide member contact means contacting said valve stem end upon selective actuation of said actuator anchor plate to move said valve into said second, open operating position;

(j) said space providing tolerance for valve stem heat expansion and valve travel adjustment; and (k) an adjusting solenoid disposed in association with said guide means to cause said guide means to reciprocate relative to said actuating solenoid.

2. An improved actuator assembly system as in claim 1 wherein:

(a) said guide means comprises a guide sleeve receivingly engaging said anchor guide member, and said guide member is a rod member.

3. An improved actuator assembly system as in claim 1 wherein:

(a) said anchor guide member includes an axial bore adapted to receive said guide means therein, and said guide means is a rod member.

4. An improved actuator assembly system as in claim 1 wherein:

(a) said valve stem is reciprocatingly guided in a guide sleeve; and (b) said anchor guide member and said guide means are disposed with sliding tolerances smaller then the tolerances between said valve stem and its guide sleeve, thereby to permit gerater accuracy of guidance of said actuator assembly than said valve.

5. An improved actuator assembly system as in claim 4 wherein:

(a) said valve stem is lubricated; and (b) said anchor guide member is reciprocatingly movable in said guide means as a substantially dry bearing.

6. An improved actuator assembly system as in claim 1 wherein:

(a) said reciprocating actuator assembly includes at least one spring member having two opposed ends mounted coaxially around said guide assembly and disposed in a bore in said actuating solenoid;

(b) said guide assembly includes means for engaging a first end of said spring member;

(c) said anchor plate engaging the other end of said spring;

(d) said spring being tensioned to urge said anchor plate away from said actuating solenoid into contact with said valve stem end;

(e) said adjusting solenoid is adapted to shift the locus of the means engaging the first end of said spring; and (f) said actuating solenoid, guide assembly, adjusting solenoid and spring member are disposed in a modular housing adapted to be preassembled for slipping over the end of said valve stem.

7. An improved actuator assembly system as in claim 6 wherein:

(a) said guide means is disposed in a bore in the core of said adjusting solenoid and (b) the bores in said cores are coaxial and said actuating solenoid bore is larger than said adjusting solenoid bore.

8. An improved actuator assembly system as in claim 6 wherein:

(a) said housing includes means for axial shift of said contact means relative to said end of said valve stem.

9. An improved actuator assembly system as in claim 8 wherein:

(a) said axial shift means includes bolts for securing said housing to the cylinder head of said displacement machine;

(b) said axial shift means includes shim means disposed in association with said bolts to provide precise axial shift.

10. An improved actuator assembly system as in claim 8 wherein:

(a) said axial shift means includes at least one member circumferentially surrounding said housing and adapted to provide precise axial shaft.

11. An improved actuator assembly system as in claim 10 wherein:

(a) said circumferential member comprises at least a pair of stacked cooperating shim members, each having an oblique surface;

(b) said shim members being disposed to permit change in the overall height of said shim stack by rotation of the shims relative to one another.

12. An improved actuator assembly system as in claim 1 wherein:

(a) said positioning mechanism is disposed in association with at least one gas exchange valve in an internal combustion engine.

13. An improved actuator assembly system as in claim 2 wherein:

(a) said positioning mechanism is disposed in association with at least one gas exchange valve in an internal combustion engine.

14. An improved actuator assembly system as in claim 3 wherein:

(a) said housing is disposed in association with at least one gas exchange valve in an internal combustion engine.

15. An improved actuator assembly system as in claim 6 wherein:

(a) said guide means comprises a guide sleeve receivingly engaging said anchor guide member, and said guide member is a rod member.

16. An improved actuator assembly system as in claim 9 wherein:

(a) said guide means comprises a guide sleeve receivingly engaging said anchor guide member, and said guide member is a rod member.

17. An improved actuator assembly system as in claim 11 wherein:

(a) said guide means comprises a guide sleeve receivingly engaging said anchor guide member, and said guide member is a rod member.

18. An improved actuator assembly system as in claim 6 wherein:

(a) said anchor guide member includes an axial bore adapted to receive said guide means therein, and said guide means is a rod member.

19. An improved actuator assembly system as in claim 9 wherein:

(a) said anchor guide member includes an axial bore adapted to receive said guide means therein, and said guide means is a rod member.

20. An improved actuator assembly system as in claim 11 wherein:

(a) said anchor guide member includes an axial bore adapted to receive said guide means therein, and said guide means is a rod member.

* * * * *